US010086494B2

(12) United States Patent
Weis et al.

(10) Patent No.: US 10,086,494 B2
(45) Date of Patent: Oct. 2, 2018

(54) HIGH PLANARIZATION EFFICIENCY CHEMICAL MECHANICAL POLISHING PADS AND METHODS OF MAKING

(71) Applicants: Rohm and Haas Electronic Materials CMP Holdings, Inc., Newark, DE (US); Dow Global Technologies LLC, Midland, MI (US)

(72) Inventors: Jonathan G. Weis, Bear, DE (US); George C. Jacob, Newark, DE (US); Bhawesh Kumar, Lake Jackson, TX (US); Sarah E. Mastroianni, Rochester, MI (US); Wenjun Xu, Pottstown, PA (US); Nan-Rong Chiou, Wilmington, DE (US); Mohammad T. Islam, Newark, DE (US)

(73) Assignees: Rohm and Haas Electronic Materials CMP Holdings, Inc., Newark, DE (US); Dow Global Technologies LLC, Midland, MI (US)

( * ) Notice: Subject to any disclaimer, the term of this patent is extended or adjusted under 35 U.S.C. 154(b) by 24 days.

(21) Appl. No.: 15/264,056

(22) Filed: Sep. 13, 2016

(65) Prior Publication Data

US 2018/0071888 A1 Mar. 15, 2018

(51) Int. Cl.

| | |
|---|---|
| ***B24B 37/24*** | (2012.01) |
| ***B24D 11/00*** | (2006.01) |
| ***B24B 37/22*** | (2012.01) |
| ***B24B 53/017*** | (2012.01) |

(52) U.S. Cl.

CPC ..... *B24B 37/245* (2013.01); *B24B 37/22* (2013.01); *B24B 37/24* (2013.01); *B24B 53/017* (2013.01); *B24D 11/00* (2013.01)

(58) Field of Classification Search

CPC ..... B24B 37/22; B24B 37/24; B24B 37/245; B24B 53/017; B24D 11/00; B24D 11/001

USPC ..... 451/526, 533

See application file for complete search history.

(56) References Cited

U.S. PATENT DOCUMENTS

| | | | | |
|---|---|---|---|---|
| 6,860,802 | B1 | 3/2005 | Vishwanathan et al. | |
| 7,169,030 | B1 | 1/2007 | Kulp | |
| 7,445,847 | B2 | 11/2008 | Kulp | |
| 8,697,239 | B2 | 4/2014 | Kulp et al. | |
| 9,102,034 | B2 * | 8/2015 | Jensen | B24B 37/205 |
| 9,259,820 | B2 * | 2/2016 | Qian | B24B 37/013 |
| 2004/0058623 | A1 | 3/2004 | Lin et al. | |
| 2011/0034578 | A1 * | 2/2011 | Zhang | B24B 37/24 521/160 |
| 2013/0298472 | A1 * | 11/2013 | Alden | B24B 37/24 51/298 |
| 2013/0298473 | A1 * | 11/2013 | Wank | B24B 37/24 51/298 |
| 2013/0303061 | A1 * | 11/2013 | James | B24B 37/24 451/526 |
| 2015/0059254 | A1 * | 3/2015 | Yeh | B24B 37/24 51/298 |
| 2015/0273652 | A1 * | 10/2015 | Qian | B24B 37/013 438/692 |
| 2015/0306730 | A1 * | 10/2015 | Qian | B24B 37/013 51/298 |
| 2015/0306731 | A1 * | 10/2015 | Qian | B24B 37/24 51/298 |
| 2015/0375361 | A1 * | 12/2015 | Qian | B24B 37/205 216/53 |
| 2015/0375362 | A1 * | 12/2015 | Qian | B24B 37/24 438/693 |
| 2016/0052103 | A1 * | 2/2016 | Qian | B24B 37/24 51/296 |
| 2016/0065013 | A1 | 3/2016 | Chung | |
| 2016/0375543 | A1 * | 12/2016 | Qian | B24B 37/24 216/38 |
| 2016/0375545 | A1 * | 12/2016 | Qian | G02B 1/12 438/692 |
| 2016/0375550 | A1 * | 12/2016 | Tong | B24D 11/001 264/48 |
| 2016/0375552 | A1 * | 12/2016 | Qian | B24D 18/00 51/298 |
| 2016/0375553 | A1 * | 12/2016 | Veneziale | B24D 18/00 51/298 |

* cited by examiner

*Primary Examiner* — Eileen Morgan
(74) *Attorney, Agent, or Firm* — Andrew Merriam

(57) ABSTRACT

A chemical mechanical polishing pad for polishing a semiconductor substrate is provided containing a polishing layer that comprises a polyurethane reaction product of a reaction mixture comprising a curative and a polyisocyanate prepolymer having an unreacted isocyanate (NCO) concentration of from 8.3 to 9.8 wt. % and formed from a polyol blend of polypropylene glycol (PPG) and polytetramethylene ether glycol (PTMEG) and containing a hydrophilic portion of polyethylene glycol or ethylene oxide repeat units, a toluene diisocyanate, and one or more isocyanate extenders, wherein the polyurethane reaction product exhibits a wet Shore D hardness of from 10 to 20% less than the Shore D hardness of the dry polyurethane reaction product.

10 Claims, No Drawings

HIGH PLANARIZATION EFFICIENCY CHEMICAL MECHANICAL POLISHING PADS AND METHODS OF MAKING

The present invention relates to chemical mechanical polishing pads and methods of making and using the same. More particularly, the present invention relates to a chemical mechanical polishing pad comprising a polishing layer or top polishing surface of a polyurethane reaction product of a reaction mixture comprising a curative, such as one or more polyamine and a polyisocyanate prepolymer formed from a polyol blend of polypropylene glycol (PPG), polytetramethylene ether glycol (PTMEG), polyethylene glycol, a toluene diisocyanate, and one or more isocyanate extenders, such as diethylene glycol, and wherein the polyurethane reaction product in the polishing pad has a Shore D hardness according to ASTM D2240-15 (2015) of from 65 to 80 and exhibits a wet Shore D hardness of from 10 to 20% less or, preferably, at least 11% less than the Shore D hardness of the polyurethane reaction product when dry.

In the production of any semiconductor, several chemical mechanical polishing (CMP) processes may be needed. In each CMP process, a polishing pad in combination with a polishing solution, such as an abrasive-containing polishing slurry or an abrasive-free reactive liquid, removes excess material in a manner that planarizes or maintains flatness of the semiconductor substrate. The stacking of multiple layers in semiconductors combines in a manner that forms an integrated circuit. The fabrication of such semiconductor devices continues to become more complex due to requirements for devices with higher operating speeds, lower leakage currents and reduced power consumption. In terms of device architecture, this translates to finer feature geometries and increased numbers of metallization levels or layers. Such increasingly stringent device design requirements drive the adoption of smaller line spacing with a corresponding increase in pattern density and device complexity. These trends have led to greater demands on CMP consumables such as polishing pads and polishing solutions. In addition, as the feature sizes decrease and become more complex in semiconductors, CMP-induced defectivity, such as scratching becomes a greater issue.

There is an ongoing need for polishing pads that have increased removal rate in combination with acceptable defectivity performance and layer uniformity. In particular, there is a desire for polishing pads suitable for inter-layer dielectric (ILD) polishing with an accelerated oxide removal rate in combination with acceptable planarization and defectivity polishing performance. However, there has remained in the industry a performance tradeoff between planarization efficiency (PE) and defectivity with greater PE resulting in more defects.

U.S. Pat. No. 8,697,239 B2, to Kulp et al. discloses polyurethane polishing pads which comprise the polyurethane reaction product of polyol blend mixture of 15 to 77 wt. % total polypropylene glycol and polytetramethylene ether glycol, from 8 to 50 wt. % of a polyamine or polyamine mixture and from 15 to 35 wt. % toluene diisocyanate, wherein the weight ratio of the polypropylene glycol to the polytetramethylene ether glycol in the polyol blend ranges from 20:1 to 1:20. The toluene diisocyanate can be partially pre-reacted with polyol to make a prepolymer. Where the polishing pads in Kulp enable improved defectivity, the planarization efficiency (PE) of those polishing pads needs improvement.

The present inventors have sought to solve the problem of providing an effective chemical mechanical polishing pad that provides improved (reduced) defectivity without a corresponding drop in planarization efficiency (PE).

STATEMENT OF THE INVENTION

1. In accordance with the present invention, chemical mechanical (CMP) polishing pads for polishing a substrate chosen from at least one of a magnetic substrate, an optical substrate and a semiconductor substrate comprise a polishing layer adapted for polishing the substrate which is a polyurethane reaction product of a reaction mixture comprising a curative, such as one or more polyamine and a polyisocyanate prepolymer having an unreacted isocyanate (NCO) concentration of from 8.3 to 9.8 wt. %, or, preferably, from 8.6 to 9.3 wt. % of the polyisocyanate prepolymer, the polyisocyanate prepolymer formed from reactants which are a polyol blend of polypropylene glycol (PPG) and polytetramethylene ether glycol (PTMEG) and containing a hydrophilic portion which can be polyethylene glycol or ethylene oxide repeat units, a toluene diisocyanate, and one or more isocyanate extenders, such as diethylene glycol, wherein the amount of toluene diisocyanate (TDI) used to form the polyisocyanate prepolymer ranges from 33 to 46 wt. %, or, preferably, from more than 35 wt. % to 45 wt. % based on the total wt. % of the reactants used to make the polyisocyanate prepolymer, and, further wherein, the polyurethane reaction product in the polishing pad has a Shore D hardness according to ASTM D2240-15 (2015) of from 65 to 80 and exhibits a wet Shore D hardness of from 10 to 20% less than the (dry) Shore D hardness of the polyurethane reaction product or, preferably, at least 11% less.

2. In accordance with the chemical mechanical polishing pad of present invention as in item 1, above, wherein the amount of toluene diisocyanate (TDI) used to form the polyisocyanate prepolymer ranges from 33 to 46 wt. %, or, preferably, from more than 35 wt. % to 45 wt. % based on the total wt. % of the reactants used to make the polyisocyanate prepolymer, wherein, further, the amount of the one or more isocyanate extenders used to form the polyisocyanate prepolymer ranges from 1 to 12 wt. % or, preferably, from 3 to 11 wt. %, based on the total weight of the reactants used to make the polyisocyanate prepolymer, and wherein, still further, the amount of the polyol blend used to form the polyisocyanate prepolymer ranges from 43 to 66 wt. %, or, preferably, from 44 to 62 wt. %, such as 44 to less than 62 wt. %, based on the total wt. % of the reactants used to make the polyisocyanate prepolymer.

3. In accordance with the chemical mechanical polishing pad of present invention as in any one of items 1 or 2, above, wherein the polyol blend used to form the polyisocyanate prepolymer contains a hydrophilic portion and is chosen from (i) a polyol blend of PTMEG and PPG in a ratio of PTMEG to PPG of from 1:1.5 to 1:2 and a hydrophilic portion in the amount of from 20 to 30 wt. %, based on the total weight of reactants used to make the polyisocyanate prepolymer or (ii) a polyol blend of PTMEG and PPG in a ratio of PTMEG to PPG of from 9:1 to 12:1 wt. ratio and a hydrophilic portion in the amount of from 1 to 10 wt. %, or, preferably, from 2 to 10 wt. %, based on the total weight of reactants used to make the polyisocyanate prepolymer.

4. In accordance with the chemical mechanical polishing pad of present invention as in any one of items 1, 2, or 3, above, wherein the one or more isocyanate extenders are chosen from ethylene glycol, 1,2-propylene glycol, 1,3-propylene glycol, 1,2-butanediol, 1,3-butanediol, 2-methyl-1, 3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol and mixtures thereof.

5. In accordance with the chemical mechanical polishing pad of present invention as in any one of items 1, 2, 3 or 4, above, wherein amount of the one or more isocyanate extenders used to form the polyisocyanate prepolymer ranges from 1 to 12 wt. %, or, preferably, from 3 to 10 wt. %, based on the total weight of the reactants used to make the polyisocyanate prepolymer.

6. In accordance with the chemical mechanical polishing pad of present invention as in any one of items 1, 2, 3, 4, or 5, above, wherein the polyurethane reaction product is formed from a reaction mixture containing from 70 to 81 wt. %, or, preferably, from 73 to 78 wt. %, based on the total weight of the reaction mixture, of the polyisocyanate prepolymer, from 19 to 27.5 wt. % or, preferably, from 20 to 26.6 wt. %, based on the total weight of the reaction mixture, of the curative, such as a curative chosen from a diamine and a mixture of a diamine and a polyol curative and from 0 to 2.5 wt. %, or, preferably, from 0.4 to 2.0 wt. % or, more preferably, 0.75 to 2.0 wt. % of one or more microelements, based on the total weight of the reaction mixture. Preferably, the polyurethane reaction product is formed from a reaction mixture comprising the polyisocyanate prepolymer and the curative wherein the molar ratio of polyamine $NH_2$ groups to polyol OH groups ranges from 40:1 to 1:0, such as, for example, 50:1 to 70:1.

7. In accordance with the chemical mechanical polishing pad of present invention as in item 6, above, wherein the curative is chosen from a diamine and a mixture of a diamine and a polyol curative and the stoichiometric ratio of the sum of the total moles of amine ($NH_2$) groups and the total moles of hydroxyl (OH) groups) in the reaction mixture to the total moles of unreacted isocyanate (NCO) groups in the reaction mixture ranges from 0.91:1 to 1.15:1, or, preferably, from 0.95:1 to 1.10:1, or, more preferably, from 0.98:1 to 1.07:1.

8. In accordance with the chemical mechanical polishing pad of present invention as in any one of items 6 or 7, above, wherein the polishing pad or polishing layer has a density of 0.93 to 1.1 g/cm$^3$ or, preferably, from 0.95 to 1.08 g/cm$^3$.

9. In accordance with the chemical mechanical polishing pad of the present invention as in any one of items 6, 7 or 8, above, wherein the curative is a polyamine, or a polyamine mixed with a polyol, wherein the polyamine is chosen from 4,4'-methylene-bis(3-chloro-2,6-diethylaniline); diethyl toluene diamines; tert-butyl toluene diamines, such as 5-tert-butyl-2,4- or 3-tert-butyl-2,6-toluenediamine; chlorotoluenediamines, dimethylthio-toluene diamines; 1,2-bis(2-aminophenylthio)ethane, trimethylene glycol di-p-amino-benzoate; tert-amyl toluenediamines, such as 5-tert-amyl-2,4- and 3-tert-amyl-2,6-toluenediamine; tetramethyleneoxide di-p-aminobenzoate; (poly)propyleneoxide di-p-aminobenzoates; chloro diaminobenzoates; methylene dianilines, such as 4,4'-methylene-bis-aniline; isophorone diamine; 1,2-diaminocyclohexane, bis(4-aminocyclohexyl)methane, 4,4'-diaminodiphenyl sulfone, m-phenylenediamine; xylene diamines; 1,3-bis(aminomethyl cyclohexane); and mixtures thereof, preferably, 4,4'-methylene-bis-o-chloroaniline.

10. In accordance with the chemical mechanical polishing pad of the present invention as in any one of items 6, 7, 8, or 9, above, wherein the polyisocyanate prepolymer has a number average molecular weight (GPC) of from 500 to 1200, or, preferably, from 600 to 1000.

11. In accordance with the chemical mechanical polishing pad of the present invention as in any one of items 1, 6, 7, 8, 9, or 10, above, wherein the polishing layer of the polishing pad further comprises microelements chosen from entrapped gas bubbles, hollow core polymeric materials, such as polymeric microspheres, liquid filled hollow core polymeric materials, such as fluid-filled polymeric microspheres, and fillers, such as boron nitride, preferably, expanded fluid-filled polymeric microspheres.

12. In accordance with the chemical mechanical polishing pad of the present invention as in any one of items 1, 6, 7, 8, 9, or 10, above, wherein the polishing layer of the polishing pad further comprises from 0 to 25 wt. %, or, for example, from 0.1 to 10 wt. %, based on the total weight of the polishing layer, of an additive to lower wet Shore D hardness chosen from hydrogel fillers, such as poly(meth) acrylamides, polylactams, such as polycaproamide, polymers of hydroxyalkyl (meth)acrylates, hydrolyzed polyvinyl acetate, polyvinylpyrrolidone, polyethers, polyketones, polyvinyl alcohols, poly(meth)acrylic acids, polyvinylsulfones, poly(ethylene oxide) or block copolymers thereof; hygroscopic powders, such as bentonite or hydroxyethylcellulose; polyelectrolytes such as polyacrylic acid, poly (methacrylic acid), poly(styrene sulfonate), poly(vinylsulfonic acid) and their salts or copolymers thereof; ionic small molecules such as peralkylated ammonium salts or sulfonated benzenes; zwitterionic compounds such as quaternary ammonium propylsulfonates; hygroscopic fibers, such as poly(meth) acrylamides, polylactams, hydrolyzed polyvinyl acetate, polyvinylsulfones, poly(ethylene oxide), or polyvinylpyrrolidone; finely divided inorganic fillers that contain at least one silanol group, preferably, 1 to 10 wt. % of silanol groups, based on the total weight of the filler; silica particles functionalized with alcohols, oligomeric alcohols, or polyglycols; graphene oxide or edge-oxidized graphene platelets; finely divided inorganic fillers that contain one or more alcohol groups, such as hydrogel coated inorganic fillers, and pore forming block copolymers, such as polyether group containing organopolysiloxanes.

13. In another aspect, the present invention provides methods for making chemical mechanical (CMP) polishing pads having a polishing layer adapted for polishing a substrate comprising providing one or more polyisocyanate prepolymer as set forth in any one of items 1 to 5, above, at a temperature of from 45 to 65° C. forming a reaction mixture containing from 70 to 81 wt. %, based on the total weight of the reaction mixture, of the polyisocyanate prepolymer, from 0.4 to 2.0 wt. % or, more preferably, 0.75 to 2 wt. %, based on the total weight of the reaction mixture, of one or more microelements, wherein the microelements and the polyisocyanate prepolymer are blended together, cooling the polyisocyanate prepolymer and microelement mixture to from 20 to 40° C., or preferably, from 20 to 35° C., providing, as a separate component, from 19 to 27.5 wt. % or, preferably, from 20 to 26.6 wt. %, based on the total weight of the reaction mixture, of a curative, combining the components of the reaction mixture, preheating a mold to from 60 to 100° C., or, preferably, from 65 to 95° C., filling the mold with the reaction mixture, and heat curing the reaction mixture at a temperature of from 80 to 120° C. for a period of from 4 to 24 hours, or, preferably, from 6 to 16 hours to form a cast polyurethane; and forming a polishing layer from the cast polyurethane.

14. In accordance with the methods of making a chemical mechanical polishing pad of present invention as in item 13, above, wherein the reaction mixture is organic solvent free and substantially water-free, or, preferably, water free.

15. In accordance with the methods of making a chemical mechanical polishing pad of the present invention as in any one of items 13 or 14, above, wherein the providing a separate component of a curative further comprises mixing the curative with from 0 to 25 wt. %, or, for example, from 0.1 to 10 wt. %, based on the total weight of the reaction mixture, of an additive to lower wet Shore D hardness chosen from hydrogel fillers, such as poly(meth) acrylamides, polylactams, such as polycaproamide, polymers of hydroxyalkyl (meth)acrylates, hydrolyzed polyvinyl acetate, polyvinylpyrrolidone, polyethers, polyketones, polyvinyl alcohols, poly(meth)acrylic acids, polyvinylsulfones, poly (ethylene oxide) or block copolymers thereof; hygroscopic powders, such as bentonite or hydroxyethylcellulose; polyelectrolytes such as polyacrylic acid, poly(methacrylic acid), poly(styrene sulfonate), poly(vinylsulfonic acid) and their salts or copolymers thereof; ionic small molecules such as peralkylated ammonium salts or sulfonated benzenes; zwitterionic compounds such as quaternary ammonium propylsulfonates; hygroscopic fibers, such as poly(meth) acrylamides, polylactams, hydrolyzed polyvinyl acetate, polyvinylsulfones, poly(ethylene oxide), or polyvinylpyrrolidone; finely divided inorganic fillers that contain at least one silanol group, preferably, 1 to 10 wt. % of silanol groups, based on the total weight of the filler; silica particles functionalized with alcohols, oligomeric alcohols, or polyglycols; graphene oxide or edge-oxidized graphene platelets; finely divided inorganic fillers that contain one or more alcohol groups, such as hydrogel coated inorganic fillers, and pore forming block copolymers, such as polyether group containing organopolysiloxanes.

16. In accordance with the methods of making a chemical mechanical polishing pad of present invention as in any one of items 13, 14 or 15 above, wherein the forming a polishing layer comprises skiving or slicing the cast polyurethane to form a polishing layer having a desired thickness.

17. In accordance with the methods of making a chemical mechanical polishing pad of present invention as in item 16, above, wherein the forming a polishing layer further comprises post-curing the polishing layer at a temperature of from 85 to 165° C., or, from 95 to 125° C., for a period of time, such as from 2 to 30 hours, or, preferably, from 4 to 20 hours.

18. In accordance with the methods of the present invention as in any one of items 13 to 17, above, wherein the forming of the polishing pad further comprises stacking a sub pad layer, such as a polymer impregnated non-woven, or polymer sheet, onto bottom side of a polishing layer so that the polishing layer forms the top of the polishing pad.

19. In yet another aspect, the present invention provides methods of polishing a substrate, comprising: Providing a substrate selected from at least one of a magnetic substrate, an optical substrate and a semiconductor substrate; providing a chemical mechanical (CMP) polishing pad according to any one of items 1 to 12 above; creating dynamic contact between a polishing surface of the polishing layer of the CMP polishing pad and the substrate to polish a surface of the substrate; and, conditioning of the polishing surface of the polishing pad with an abrasive conditioner.

Unless otherwise indicated, conditions of temperature and pressure are ambient temperature and standard pressure. All ranges recited are inclusive and combinable.

Unless otherwise indicated, any term containing parentheses refers, alternatively, to the whole term as if no parentheses were present and the term without them, and combinations of each alternative. Thus, the term "(poly) isocyanate" refers to isocyanate, polyisocyanate, or mixtures thereof.

All ranges are inclusive and combinable. For example, the term "a range of 50 to 3000 cPs, or 100 or more cPs" would include each of 50 to 100 cPs, 50 to 3000 cPs and 100 to 3000 cPs.

As used herein, the term "ASTM" refers to publications of ASTM International, West Conshohocken, Pa.

As used herein, the term "stoichiometry" of a reaction mixture refers to the ratio of molar equivalents of (free OH+free $NH_2$ groups) to free NCO groups in the reaction mixture.

As used herein, the term "SG" or "specific gravity" refers to the weight/volume ratio of a rectangular cut out of a polishing pad or layer in accordance with the present invention.

As used herein, the term "elongation to break" is the ratio between changed length after breakage of a test specimen and initial length, and tested in accordance with ASTM D412-06a (2006), "Standard Test Methods for Vulcanized Rubber and Thermoplastic Elastomers-Tension." Unless otherwise indicated, five test specimens were measured and an average of all tested specimens for each analyte sample were reported.

As used herein, the terms G', G", and G"/G' (which corresponds to tan delta), respectively, refer to shear storage modulus, shear loss modulus, and the ratio of the shear loss modulus to the shear storage modulus. Test specimens were cut with 6.5 mm width and 36 mm length. An ARES™ G2 torsional rheometer or a Rheometric Scientific™ RDA3 (both from TA Instruments, New Castle, Del.) were used in accordance with ASTM D5279-13 (2013), "Standard Test Method for Plastics: Dynamic Mechanical Properties: In Torsion." The gap separation was 20 mm. Instrument analysis parameters were set at 100 g of preload, 0.2% strain, oscillation speed of 10 rads/sec, and temperature ramp rate of 3° C./min from −100° C. to 150° C.

As used herein, the term "hydrophilic portion" of an extender or a polyol reactant refers to that portion of the indicated material which comprises ethylene oxide —($CH_2CH_2O$)— or EO repeat units; such EO units can comprise repeat units, as in the case of an oligo(ethylene glycol) or poly(ethylene glycol).

As used herein, the term "polyisocyanate" means any isocyanate group containing molecule having three or more isocyanate groups, including blocked isocyanate groups.

As used herein, the term "polyisocyanate prepolymer" means any isocyanate group containing molecule that is the reaction product of an excess of a diisocyanate or polyisocyanate with an active hydrogen containing compound containing two or more active hydrogen groups, such as diamines, diols, triols, and polyols.

As used herein, the term "polyurethanes" refers to polymerization products from difunctional or polyfunctional isocyanates, e.g. polyetherureas, polyisocyanurates, polyurethanes, polyureas, polyurethaneureas, copolymers thereof and mixtures thereof.

As used herein, the term "reaction mixture" includes any non-reactive additives, such as microelements and any additives to lower wet Shore D hardness of a polyurethane reaction product in the polishing pad according to ASTM D2240-15.

As used herein, the term "Shore D hardness" is the hardness of a given material as measured according to ASTM D2240-15 (2015), "Standard Test Method for Rubber Property-Durometer Hardness". Hardness was measured on a Rex Hybrid hardness tester (Rex Gauge Company, Inc., Buffalo Grove, Ill.), equipped with a D probe. Six samples were stacked and shuffled for each hardness measurement;

and each pad tested was conditioned by placing it in 50 percent relative humidity for five days at 23° C. before testing and using methodology outlined in ASTM D2240-15 (2015) to improve the repeatability of the hardness tests. In the present invention, the Shore D hardness of the polyurethane reaction product of the polishing layer or pad includes the Shore D hardness of that reaction including any additive to lower Shore D hardness.

As used herein, unless otherwise indicated, the term "viscosity" refers to the viscosity of a given material in neat form (100%) at a given temperature as measured using a rheometer, set at an oscillatory shear rate sweep from 0.1-100 rad/sec in a 50 mm parallel plate geometry with a 100 μm gap.

As used herein, unless otherwise indicated, the term "number average molecular weight" or "Mn" and "weight average molecular weight" or "Mw" means that value determined by gel permeation chromatography (GPC) at room temperature using an Agilent 1100 High Pressure Liquid Chromatogram (HPLC) (Agilent, Santa Clara, Calif.) equipped with an isocratic pump, an autosampler (Injection volume (50 μl) and a Series of 4 PL-Gel™ (7 mm×30 cm×5 μm) columns, each filled with a polystyrene divinyl benzene (PS/DVB) gel in a succession of pore sizes of 50, 100, 500 and then 1000 Å against a standard calibrated from a polyol mixture (1.5 wt. % in THF) of polyethylene glycols and polypropylene glycols as standards. For polyisocyanate prepolymers, the isocyanate functional (N═C═O) groups of the isocyanate samples were converted with methanol from a dried methanol/THF solution to non-reactive methyl carbamates.

As used herein, unless otherwise indicated, the term "wt. % NCO" refers to the amount of unreacted or free isocyanate groups a given polyisocyanate prepolymer composition.

As used herein, the term "wt. %" stands for weight percent.

In accordance with the present invention, a chemical mechanical (CMP) polishing pad has a top polishing surface comprising the reaction product of a reaction mixture of a curative, such as one or more polyamine and a polyisocyanate prepolymer formed from a polyol blend of polypropylene glycol (PPG), polytetramethylene ether glycol (PTMEG), polyethylene glycol, toluene diisocyanate, and one or more isocyanate extenders, such as a diol or a glycol. The polishing layer in accordance with the present invention maintains favorable pad surface texture, high tensile modulus and strength (as measured by Alliance RT/5 (MTS Systems Corporation) tensile measurements in accordance with ASTM D412-06a (2006), and a high damping component in the relevant polishing temperature regime (i.e., G"/G' measured by shear dynamic mechanical analysis (DMA), ASTM D5279-08 (2008); however, the pads or polishing layers exhibit a unique decrease in hardness between dry and wet state. The decrease in hardness enables the pads to maintain a high planarization efficiency (PE) while exhibiting significantly attenuated defectivity in use with aqueous polishing slurries.

The present invention provides multi-functional pads useful for tungsten and interlayer dielectric (ILD) polishing. In particular, pads manufactured with these ranges can provide improved polishing performance at least as good as industry standard IC1000 polishing pads.

The polyol blend component used to make the polyisocyanate prepolymer of present invention comprises a hydrophilic portion which can be polyethylene glycol or ethylene oxide repeat units. Specifically, an amount of from 2 to 30 wt. %, based on the total weight of the polyisocyanate prepolymer (absent the curative), is desirable.

In the polyisocyanate prepolymer of the present invention, the toluene diisocyanate (TDI) of the present invention is extended with from 1 to 12 wt. % of one or more extenders, or, preferably, from 3 to 11 wt. %, based on the total weight of the polyisocyanate prepolymer absent the curative.

The polishing pads of the invention are efficacious for tungsten, copper, and ILD polishing. In particular, the pads can decrease defectivity while maintaining oxide removal rate. Alternatively, the pads can lower defectivity without a corresponding decrease in removal rate. For purposes of the specification, the removal rate refers to the removal rate as expressed in A/min.

The chemical mechanical polishing pads of the present invention comprise a polishing layer which is a homogenous dispersion of microelements in a porous polyurethane or a homogeneous polyurethane. Homogeneity is important in achieving consistent polishing pad performance, especially where a single casting is used to make multiple polishing pads. Accordingly, the reaction mixture of the present invention is chosen so that the resulting pad morphology is stable and easily reproducible. For example, it is often important to control additives such as anti-oxidizing agents, and impurities such as water for consistent manufacturing. Because water reacts with isocyanate to form gaseous carbon dioxide and a weak reaction product relative to urethanes generally, the water concentration can affect the concentration of carbon dioxide bubbles that form pores in the polymeric matrix as well as the overall consistency of the polyurethane reaction product. Isocyanate reaction with adventitious water also reduces the available isocyanate for reacting with chain extender, so changing the stoichiometry along with level of crosslinking (if there is an excess of isocyanate groups) and tends to lower resulting polymer molecular weight.

To insure homogeneity and good molding results and fill the mold completely, the reaction mixture of the present invention should be well dispersed.

In accordance with the present invention, a reaction mixture comprises, on one hand, at least toluene diisocyanate and the polyol component, or a polyisocyanate prepolymer made from toluene diisocyanate and the polyol component and, on the other hand, one or more polyamines. The polishing properties of the pads of the present invention arise in part from the pad composition which is a reaction product of a polyol component of polypropylene glycol (PPG), polyethylene glycol (PEG) and polytetramethylene ether glycol (PTMEG), with one or more isocyanate extenders, a polyamine and an isocyanate component of toluene diisocyanate.

The polyurethane polymeric material or reaction product is preferably formed from, on the one hand, a polyisocyanate prepolymer reaction product of toluene diisocyanate with a polyol blend of polytetramethylene ether glycol (PTMEG) with polypropylene glycol (PPG) and polyethylene glycol (PEG) or with PPG having ethylene oxide repeat units, which are hydrophilic groups and, on the other hand a polyamine or polyamine mixture. Preferably, the polyamine is an aromatic diamine. Most preferably, the aromatic diamine is 4,4'-methylene-bis-o-chloroaniline.

The toluene diisocyanate is partially reacted with the polyol blend to form a polyisocyanate prepolymer prior to producing the final polymer matrix.

The polyisocyanate prepolymer can further be combined with methylene diphenyl diisocyanate (MDI) or diol or polyether extended MDI, wherein MDI is present in the amount of from 0 to 15 wt. %, or, for example, up to 12 wt. % or, for example, from 0.1 to 12 wt. %, based on the total weight of the toluene diisocyanate used to make the polyisocyanate prepolymer plus the total weight of the MDI. For clarity, the weight of MDI in the case of a diol or polyether extended MDI is considered to be the weight fraction of MDI itself in the extended MDI.

For purposes of this specification, the formulations are expressed in wt. %, unless specifically noted otherwise.

The polyisocyanate prepolymer of the present invention is the reaction product of a mixture containing the TDI and a total of 43 to 66 wt. % or, preferably, 45 to 62 wt. %, such as from 45 to less than 62 wt. %, of the polyol blend (PPG, PEG and PTMEG) plus isocyanate extender, based on the total weight of reactants used to make the prepolymer. The remainder of the reaction mixture comprises the curative, such as one or more polyamine.

The polyisocyanate prepolymer of the present invention is formed from a reaction mixture containing the toluene diisocyanate, and a total of from 55 to 67 wt. %, or, preferably, from 55 to 65 wt. %, or 55 to less than 65 wt. % of the polyol blend plus extender.

The polishing layer of the present invention is formed from reaction mixture of the polyisocyanate prepolymer and the curative, wherein the amount of the curative ranges from 19 to 27.5 wt. % or, preferably, from 20 to 26.6 wt. %, based on the total weight of the reaction mixture.

A suitable polyisocyanate prepolymer is formed from a mixture of toluene diisocyanate (TDI), i.e. as a partially reacted monomer, of from 33 to 46 wt. %, or, preferably, from more than 35 to 45 wt. %. For purposes of this specification, TDI monomer or partially reacted monomer represents the wt. % TDI monomer or TDI monomer reacted into a prepolymer before curing the polyurethane and does not include the other reactants that form the partially reacted monomer. Optionally, the TDI portion of the mixture may also contain some aliphatic isocyanate. Preferably, the diisocyanate component contains less than 15 wt. % aliphatic isocyanates and more preferably, less than 12 wt. % aliphatic isocyanate. Most preferably, the mixture contains only impurity levels of aliphatic isocyanate.

In accordance with the present invention, the polyisocyanate prepolymer comprises toluene diisocyanate extended or reacted with the polyol blend of the present invention and one or more extender. Suitable extenders may include ethylene glycol, 1,2-propylene glycol, 1,3-propylene glycol, 1,2-butanediol, 1,3-butanediol, 2-methyl-1, 3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol and mixtures thereof.

Available examples of PTMEG containing polyols are as follows: Terathane™ 2900, 2000, 1800, 1400, 1000, 650 and 250 from Invista, Wichita, Kans.; Polymeg™ 2900, 2000, 1000, 650 from Lyondell Chemicals, Limerick, Pa.; PolyTHF™ 650, 1000, 2000 from BASF Corporation, Florham Park, N.J. Available examples of PPG containing polyols are as follows: Arcol™ PPG-425, 725, 1000, 1025, 2000, 2025, 3025 and 4000 from Covestro, Pittsburgh, Pa.; Voranol™ 1010L, 2000L, and P400 from Dow, Midland, Mich.; Desmophen™ 1110BD or Acclaim™ Polyol 12200, 8200, 6300, 4200, 2200, each from Covestro.

To increase the reactivity of a polyol with a diisocyanate or polyisocyanate to make a polyisocyanate prepolymer, a catalyst may be used. Suitable catalysts include, for example, oleic acid, azelaic acid, dibutyltindilaurate, 1,8-diazabicyclo[5.4.0]undec-7-ene (DBU), tertiary amine catalysts, such as Dabco TMR, and mixture of the above.

A suitable polyisocyanate prepolymer of the present invention has a viscosity in neat form of 10,000 mPa·s or less at 110° C. or, preferably, from 20 to 5,000 mPa·s.

Examples of suitable commercially available PTMEG containing isocyanate terminated urethane prepolymers include Imuthane™ prepolymers (available from COIM USA, Inc., West Deptford, N.J.) such as, PET-80A, PET-85A, PET-90A, PET-93A, PET-95A, PET-60D, PET-70D, or PET-75D; Adiprene™ prepolymers (Chemtura, Philadelphia, Pa.), such as, for example, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D or L325); Andur™ prepolymers (Anderson Development Company, Adrian, Mich.), such as, 70APLF, 80APLF, 85APLF, 90APLF, 95APLF, 60DPLF, 70APLF, or 75APLF.

Examples of commercially available PPG-containing isocyanate-terminated urethane prepolymers include Adiprene™ prepolymers (Chemtura), such as LFG 963A, LFG 964A, LFG 740D; Andur™ prepolymers (Anderson Development Company, Adrian, Mich.), such as, 7000 AP, 8000 AP, 6500 DP, 9500 APLF, 7501, or DPLF. A particular example of a suitable PTMEG-containing prepolymer capable of producing polymers within this TDI range is Adiprene™ prepolymer LF750D manufactured by Chemtura. Examples of suitable PPG-based prepolymers include Adiprene™ prepolymer LFG740D and LFG963A.

In addition, the polyisocyanate prepolymers of the present invention are low-free isocyanate prepolymers that have less than 0.1 wt. % each of free 2,4 and 2,6 TDI monomers and has a more consistent prepolymer molecular weight distribution than conventional prepolymers. "Low free" prepolymers with improved prepolymer molecular weight consistency and low free isocyanate monomer content facilitate a more regular polymer structure, and contribute to improved polishing pad consistency.

Preferably, the polyisocyanate prepolymer used in the formation of the polishing layer of the chemical mechanical polishing pad of the present invention has an unreacted isocyanate (NCO) concentration of from 8.3% to 9.8%, or, preferably, from 8.6 to 9.3 wt. %.

Preferably, the polyurethane used in the formation of the polishing layer of the chemical mechanical polishing pad of the present invention is a low free isocyanate-terminated urethane having less than 0.1 wt % free toluene diisocyanate (TDI) monomer content.

In accordance with the present invention, the reaction mixture comprises a polyisocyanate prepolymer and a curative in a molar ratio of polyamine $NH_2$ groups to polyol OH groups of 40:1 to 1:0, wherein when the molar ratio is 1:0 there are no OH groups remaining in the reaction mixture.

Typically, the reaction mixture contains a curative which is one or more polyamine, such as a diamine, or polyamine-containing mixture. For example, it is possible to mix the polyamine with an alcohol amine or a monoamine. For purposes of this specification, polyamines include diamines and other multifunctional amines. Examples of suitable polyamines include aromatic diamines or polyamines, such as, 4,4'-methylene-bis-o-chloroaniline (MbOCA); dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane, 4,4'-methylene-bis-aniline; dialkyl-toluene diamines, such as diethyltoluenediamine; 5-tert-butyl-2,4- and 3-tert-butyl-2,6-toluenediamine; 5-tert-amyl-2,4- and 3-tert-amyl-2,6-toluenediamine and chlorotoluenediamine. A diamine curative of the present invention can be a mixture of 3,5-diethyltoluene-2,4-diamine and 3,5-diethyltoluene-2,6-diamine. Aliphatic diamines generally react too fast for bulk polymerization to form chemical mechanical polishing pads.

To insure that the resulting pad morphology is stable and easily reproducible, for example, it is often important to control additives such as anti-oxidizing agents, and impurities such as water for consistent manufacturing. For example, because water reacts with isocyanate to form gaseous carbon dioxide, the water concentration can affect the concentration of carbon dioxide bubbles that form pores in the polymeric matrix. Isocyanate reaction with adventitious water also reduces the available isocyanate for reacting with the polyamine, so it changes the molar ratio of OH or $NH_2$ to NCO groups along with the level of crosslinking (if there is an excess of isocyanate groups) and resulting polymer molecular weight.

The polyurethane reaction product is formed from a prepolymer reaction product of partially extended toluene diisocyanate with a polytetramethylene ether glycol/polypropylene glycol blend, a hydrophilic component, an isocyanate extender and a polyamine. Preferably, the polyamine is an aromatic toluene diisocyanate. Most preferably, the aromatic diamine is 4,4'-methylene-bis-o-chloroaniline or 4,4'-methylene-bis-(3-chloro-2,6-diethylaniline).

In the reaction mixture of the present invention, the stoichiometric ratio of the sum of the total amine ($NH_2$) groups and the total hydroxyl (OH) groups in the reaction mixture to the sum of the unreacted isocyanate (NCO) groups in the reaction mixture ranges from 0.91:1 to 1.15:1, or, preferably, 0.98:1 to 1.07:1 or, preferably, from 1:1 to 1.07:1.

The reaction mixture of the present invention is free of added organic solvents.

The reaction mixture can further comprise one or more material to lower wet Shore D hardness of a polyurethane reaction product in the polishing pad according to ASTM D2240-15 to a level of from 10 to 20% less than the (dry) Shore D hardness of the polyurethane reaction product or, preferably, at least 11% less. Such additives augment the already reduced wet Shore D hardness of the polyurethane reaction product of the present invention. Accordingly, the additives to lower wet Shore D hardness need not be used in large amounts or in some cases at all. The additives to lower wet Shore D hardness are, when used, combined with the curative component to form the polishing layer of the present invention.

Preferably, the reaction mixture of the present invention is "substantially water free" (less than 2,000 ppm), based on the total weight of the reaction mixture.

In accordance with the methods of making the polishing layer of the present invention, the methods comprise providing the polyisocyanate prepolymer of the present invention at a temperature of from 45 to 65° C., cooling the prepolymer to from 20 to 40° C., or preferably, from 20 to 30° C., forming the reaction mixture of the polyisocyanate prepolymer and, if desired, a microelement material as one component and the curative as another component, preheating a mold to from 60 to 100° C., or, preferably, from 65 to 95° C., filling the mold with the reaction mixture and heat curing the reaction mixture at a temperature of from 80 to 120° C. for a period of from 4 to 24 hours, or, preferably, from 6 to 16 hours to form a molded polyurethane reaction product.

The methods of forming the polishing layer of the present invention comprising skiving or slicing the molded polyurethane reaction product to form a layer having a thickness of from 0.5 to 10 mm, or, preferably, from 1 to 3 mm.

The methods of making the polishing layer of the present invention enable the making of a low porosity pad from a reaction mixture that gives a large exotherm and cures unusually fast and makes a hard molded polyurethane reaction product. The cooling of the polyisocyanate prepolymer component and preheating of the mold prevents mold or cake popping, where the cured or cast material demolds from base and cannot be skived or sliced to form a polishing layer. In addition, the methods of the present invention avoids heterogeneous secondary expansion of microelements and limits the variability of SG in the resulting mold or cake, thereby increasing the yield of polishing layers from the mold or cake after skiving or slicing.

The chemical mechanical polishing pads of the present invention can comprise just a polishing layer of the polyurethane reaction product or the polishing layer stacked on a subpad or sub layer. The polishing pad or, in the case of stacked pads, the polishing layer of the polishing pad of the present invention is useful in both porous and non-porous or unfilled configurations. Regardless of whether it is porous or non-porous, the finished polishing pad or polishing layer (in a stacked pad) has a density of 0.93 to 1.1 g/cm$^3$ or, preferably, from 0.95 to 1.08 g/cm$^3$. It is possible to add porosity through gas dissolution, blowing agents, mechanical frothing and introduction of hollow microspheres. Polishing pad density is as measured according to ASTM D1622-08 (2008). Density correlates closely, within 1-2% of specific gravity.

The porosity in the polishing layer of the present invention typically has an average diameter of 2 to 50 μm. Most preferably, the porosity arises from hollow polymeric particles having a spherical shape. Preferably, the hollow polymeric particles have a weight average diameter of 2 to 40 μm. For purposes of the specification, weight average diameter represents the diameter of the hollow polymeric particle before casting; and the particles may have a spherical or non-spherical shape. Most preferably, the hollow polymeric particles have a weight average diameter of 10 to 30 μm.

The polishing layer of the chemical mechanical polishing pad of the present invention optionally further comprises microelements which, preferably, are uniformly dispersed throughout the polishing layer. Such microelements, especially hollow spheres, may expand during casting. The microelements may be selected from entrapped gas bubbles, hollow core polymeric materials, such as polymeric microspheres, liquid filled hollow core polymeric materials, such as fluid filled polymeric microspheres, water soluble materials, an insoluble phase material (e.g., mineral oil), and abrasive fillers, such as boron nitride. Preferably, the microelements are selected from entrapped gas bubbles and hollow core polymeric materials uniformly distributed throughout the polishing layer. The microelements have a weight average diameter of less than 100 μm (preferably, from 5 to 50 μm). More preferably, the plurality of microelements comprise polymeric microspheres with shell walls of either polyacrylonitrile or a polyacrylonitrile copolymer (e.g., Expancel™ beads from Akzo Nobel, Amsterdam, Netherlands).

In accordance with the present invention, the microelements are incorporated into the polishing layer at from 0 to 2.5 wt. % porogen, or, preferably, 0.75 to 2.0 wt. %. Such amounts of microelements represent roughly up to 26 vol. %, preferably, from 6 to 23 vol. % porosity or, preferably, from 11 to 23 vol. %.

The polishing layer of the chemical mechanical polishing pad of the present invention exhibits a Shore D hardness of 55 to 75 as measured according to ASTM D2240-15 (2015), or, preferably, from 60 to 70 for the polishing layer or pad containing microelements.

The polyurethane reaction product of the chemical mechanical polishing pad of the present invention exhibits a wet Shore D hardness of from 10 to 20% less or, preferably, at least 11% less than the Shore D hardness of the polyurethane reaction product as measured according to ASTM D2240-15 (2015).

Polishing layers exhibiting a Shore D hardness of less than 40 typically have very high elongation to break values (i.e., >600%). Materials exhibiting such high elongation to break values irreversibly deform when subjected to machining operations, which results in groove formation that is unacceptably poor and texture creation during diamond conditioning that is insufficient. Preferably, the polishing layer of the chemical mechanical polishing pad of the present invention exhibits an elongation to break of from 100 to 450% or, preferably, from 125 to 425% (still more preferably 150 to 350%; most preferably 250 to 350%) as measured according to ASTM D412-06a (2006).

Preferably, the polishing layer used in the chemical mechanical polishing pad of the present invention has an average thickness of from 500 to 3750 microns (20 to 150 mils), or, more preferably, from 750 to 3150 microns (30 to 125 mils), or, still more preferably, from 1000 to 3000 microns (40 to 120 mils), or, most preferably, from 1250 to 2500 microns (50 to 100 mils).

The chemical mechanical polishing pad of the present invention optionally further comprises at least one additional layer interfaced with the polishing layer. Preferably, the chemical mechanical polishing pad optionally further comprises a compressible sub pad or base layer adhered to the polishing layer. The compressible base layer preferably improves conformance of the polishing layer to the surface of the substrate being polished.

The polishing layer of the chemical mechanical polishing pad of the present invention has a polishing surface adapted for polishing the substrate. Preferably, the polishing surface has macrotexture selected from at least one of perforations and grooves. Perforations can extend from the polishing surface part way or all the way through the thickness of the polishing layer.

Preferably, grooves are arranged on the polishing surface such that upon rotation of the chemical mechanical polishing pad during polishing, at least one groove sweeps over the surface of the substrate being polished.

Preferably, the polishing surface has macrotexture including at least one groove selected from the group consisting of curved grooves, linear grooves, perforations and combinations thereof.

Preferably, the polishing layer of the chemical mechanical polishing pad of the present invention has a polishing surface adapted for polishing the substrate, wherein the polishing surface has a macrotexture comprising a groove pattern formed therein. Preferably, the groove pattern comprises a plurality of grooves. More preferably, the groove pattern is selected from a groove design, such as one selected from the group consisting of concentric grooves (which may be circular or spiral), curved grooves, cross hatch grooves (e.g., arranged as an X-Y grid across the pad surface), other regular designs (e.g., hexagons, triangles), tire tread type patterns, irregular designs (e.g., fractal patterns), and combinations thereof. More preferably, the groove design is selected from the group consisting of random grooves, concentric grooves, spiral grooves, cross-hatched grooves, X-Y grid grooves, hexagonal grooves, triangular grooves, fractal grooves and combinations thereof. Most preferably, the polishing surface has a spiral groove pattern formed therein. The groove profile is preferably selected from rectangular with straight side walls or the groove cross section may be "V" shaped, "U" shaped, saw-tooth, and combinations thereof.

The methods of making a chemical mechanical polishing pad of the present invention may comprise providing a mold; pouring the reaction mixture of the present invention into the mold; and, allowing the combination to react in the mold to form a cured cake, wherein the polishing layer is derived from the cured cake. Preferably, the cured cake is skived to derive multiple polishing layers from a single cured cake. Optionally, the method further comprises heating the cured cake to facilitate the skiving operation. Preferably, the cured cake is heated using infrared heating lamps during the skiving operation in which the cured cake is skived into a plurality of polishing layers.

In accordance with the methods of making polishing pads in accordance with the present invention, chemical mechanical polishing pads can be provided with a groove pattern cut into their polishing surface to promote slurry flow and to remove polishing debris from the pad-wafer interface. Such grooves may be cut into the polishing surface of the polishing pad either using a lathe or by a CNC milling machine.

In accordance with the methods of using the polishing pads of the present invention, the polishing surface of the CMP polishing pads can be conditioned. Pad surface "conditioning" or "dressing" is critical to maintaining a consistent polishing surface for stable polishing performance. Over time the polishing surface of the polishing pad wears down, smoothing over the microtexture of the polishing to surface—a phenomenon called "glazing". Polishing pad conditioning is typically achieved by abrading the polishing surface mechanically with a conditioning disk. The conditioning disk has a rough conditioning surface typically comprised of imbedded diamond points. The conditioning process cuts microscopic furrows into the pad surface, both abrading and plowing the pad material and renewing the polishing texture.

Conditioning the polishing pad comprises bringing a conditioning disk into contact with the polishing surface either during intermittent breaks in the CMP process when polishing is paused ("ex situ"), or while the CMP process is underway ("in situ"). Typically the conditioning disk is rotated in a position that is fixed with respect to the axis of rotation of the polishing pad, and sweeps out an annular conditioning region as the polishing pad is rotated.

The chemical mechanical polishing pad of the present invention can be used for polishing a substrate selected from at least one of a magnetic substrate, an optical substrate and a semiconductor substrate.

Preferably, the method of polishing a substrate of the present invention, comprises: providing a substrate selected from at least one of a magnetic substrate, an optical substrate and a semiconductor substrate (preferably a semiconductor substrate, such as a semiconductor wafer); providing a chemical mechanical polishing pad according to the present invention; creating dynamic contact between a polishing surface of the polishing layer and the substrate to polish a surface of the substrate; and, conditioning of the polishing surface with an abrasive conditioner.

EXAMPLES

The present invention will now be described in detail in the following, non-limiting Examples:

Unless otherwise stated all temperatures are room temperature (21-23° C.) and all pressures are atmospheric pressure (~760 mm Hg or 101 kPa).

Notwithstanding other raw materials disclosed below, the following raw materials were used in the Examples:

V5055HH: Multifunctional polyol (OH Eq. wt 1900), also sold as Voralux™ HF505 high molecular weight polyol curative having a number average molecular weight, $M_N$, of 11,400 (The Dow Chemical Company, Midland, Mich. (Dow)).

Expancel™ 551 DE 40 d42 beads: Fluid filled polymeric microspheres with nominal diameter of 40 μm and true density of 42 g/l (Akzo Nobel, Arnhem, NL); and, Expancel™ 461DE 20 d70 beads: Fluid filled polymeric microspheres with nominal diameter of 20 μm and true density of 70 g/l (Akzo Nobel).

The following abbreviations appear in the Examples:

PO: Propylene oxide/glycol; EO: Ethylene oxide/glycol; PTMEG: Poly(THF) or polytetramethylene glycol; TDI: Toluene diisocyanate (~80% 2,4 isomer, ~20% 2,6 isomer); BDO: Butanediol (1,3 or 1,4 regioisomers); DEG: Diethylene glycol; MbOCA: 4,4'-Methylenebis(2-chloroaniline).

TABLE 1

Polyisocyanate Prepolymers

| Prepolymer | Backbone | PO (wt. %) | EO (wt. %) | PTMEG (wt. %) | TDI (wt. %) | BDO (wt. %) | DEG (wt. %) | NCO (wt %) | Molecular weights |
|---|---|---|---|---|---|---|---|---|---|
| A | PTMEG | 0 | 0 | 58 | 38 | 0 | 3 | ~9.0 | Mn 900; Mw 1,350 |
| B | PPG | 26 | 20 | 0 | 41 | 0 | 12 | ~9.0 | Mn 650; Mw 1,300 |
| C | PPG | 54 | 15 | 0 | 24 | 5 | 2 | ~5.8 | Mn 900; Mw 2,320 |

NMR Spectroscopy:

Was performed on homogeneous solutions of 3 g sample and 1.2 mL of a 0.025M chromium (III) acetoacetate $Cr(AcAc)_3$ solution of Acetone-$d_6$ in 10 mm NMR tubes ($Cr(AcAc)_3$ was added as a relaxation agent for quantitative $^{13}C$ NMR spectra). $^{13}C$ NMR experiments were carried out at room temperature on an AVANCE 400 spectrometer equipped with a 10 mm broadband observe (BBO) probe head (Bruker Instruments, Billerica, Mass.). Table 2, below, provides peak assignments which were integrated to give the contents of the indicated species.

TABLE 2

13C NMR Spectra and Peak Assignments for Polyurethane Prepolymers 13C NMR

| Peaks (in ppm)[1] | Assigned |
|---|---|
| 68.2, 68.5, 70.2, 70.5 | EO |
| 15.5, 17.0, 18.1, 72.4, 72.9, 74.6, 74.8 | PO |
| | PO |
| 63.8, 69.3, 69.4 | DEG |

TABLE 2-continued

13C NMR Spectra and Peak Assignments for Polyurethane Prepolymers 13C NMR

| Peaks (in ppm)[1] | Assigned |
|---|---|
| 20.0, 35.9, 60.5, 68, 2 | BDO |
| 26-28, 64-65, 69-70, 69-72.5 | PTMEG |
| 11.9, 15.5, 16.6, 109.1, 109.9, 110-142, 151.1, 152.3 | TDI (2,4 and 2,6 regioisomers) |

[1]Peak locations vary; so, all observed peak assignments from several samples are reported and ranges are given to indicate areas in which multiple peaks are clustered.

As shown in Table 3, below, formulations of various reaction mixtures were cast into polytetrafluorethylene (PTFE-coated) circular molds 86.36 cm (34") in diameter having a flat bottom to make moldings for use in making polishing pads or polishing layers. To form the formulations, the indicated polyisocyanate prepolymer heated to 52° C. to insure adequate flow and having in it the indicated microelements, as one component, and the curative, as another component were mixed together using a high shear mix head. After exiting the mix head, the formulation was dispensed over a period of 2 to 5 minutes into the mold to give a total pour thickness of 7 to 10 cm and was allowed to gel for 15 minutes before placing the mold in a curing oven. The mold was then cured in the curing oven using the following cycle: 30 minutes ramp from ambient temperature to a set point of 104° C., then hold for 15.5 hours at 104° C., and then 2 hour ramp from 104° C. to 21° C.

To cast the reaction mixture formulations as cakes with a high post-skiving yield, the inventive Examples 2, 6, and 10 were cast using a prepolymer line heat exchanger to reduce the prepolymer casting temperature to the indicated temperature from 52° C. to 27° C. (80° F.), and the molds were preheated to 93° C., this enables control of the high exotherm to mitigate variation within the mold. In the Comparative Examples 1, 3-5 and 7-9, as indicated in Table 4, below, cooling of the reaction mixture or mold preheating was varied. The reaction mixture was cooled in Comparative Example 1 because of its highly reactive reaction mixture. Porosity is proportional to microsphere loading and inversely proportional to SG; porosity was limited in the inventive Examples 2, 6 and 10 because the high exotherm would otherwise have led to uneven or uncontrolled microsphere expansion during molding.

TABLE 3

Example Formulations

| Example | Prepolymer Blend 1:2 | Blend Ratio 1:2 | Prepolymer wt. % NCO[1] | Wt. % Curative | Stoich[2] | Approx. Pore Level (Wt. %) | SG | Pore Size (μm) |
|---|---|---|---|---|---|---|---|---|
| 0* | L325[3] | | 9.05-9.25 | 20.1 | 0.87 | 1.7 | 0.80 | 40 |
| 1* | A | n/a | 8.75-9.03 | 22.9 | 1.05 | 1.4 | 0.96 | 20 |
| 2 | A:C | 9:1 | ~8.6 | 22.3 | 1.05 | 0.8 | 1.04 | 20 |
| 3* | A:C | 4:1 | 8.03-8.36 | 18.7 | 0.89 | 1.1 | 1.00 | 20 |
| 4* | A:C | 1:1 | 7.12-7.41 | 18.3 | 0.97 | 2.7 | 0.82 | 20 |
| 5* | C | n/a | ~5.7 | 14.0 | 0.90 | 1.2 | 0.91 | 40 |
| 6 | A:B | 1:4 | 8.67-9.05 | 22.8 | 1.05 | 1.1 | 1.02 | 20 |
| 7* | A:B | 1:1 | 8.70-9.04 | 21.1 | 0.95 | 5.4 | 0.64 | 20 |
| 8* | B | n/a | 8.65-9.05 | 20.4 | 0.91 | 0.8 | 1.07 | 20 |
| 9* | B | n/a | 8.67-9.05 | 20.4 | 0.91 | 0.4 | 1.07 | 40 |
| 10 | A:B | 1:4 | 8.65-9.05 | 26.1 | 1.05 | 1.5 | 0.97 | 20 |

*Denotes Comparative Example;
[1]Unreacted free NCO content;
[2]Stoichiometry refers to a ratio of (OH + $NH_2$ groups) to free NCO groups;
[3]IC1000 pad (Dow) made using ADIPRENE ™ L325 prepolymer (Chemtura).

In Examples 0 to 9 above, the polyamine curative was MbOCA and in Example 10 it was MbOCA+V5055HH polyol (5 wt. % of the total reaction mixture).

TABLE 4

Casting Parameters

| Example | E Elbow Temp (° C.) | Mold Temp | Porosity |
|---|---|---|---|
| 0* | 52 | RT | 0.30 |
| 1* | 27 | RT | 0.19 |
| 2 | 27 | 93° C. | 0.12 |
| 3* | 46 | RT | 0.15 |
| 4* | 52 | RT | 0.29 |
| 5* | 44 | RT | 0.22 |
| 6 | 27 | 93° C. | 0.15 |
| 7* | 52 | RT | 0.47 |
| 8* | 52 | 93° C. | 0.11 |
| 9* | 52 | 93° C. | 0.11 |
| 10 | 27 | 93° C. | 0.19 |

*Denotes Comparative Example.

The cured polyurethane cakes were then removed from the mold and skived (cut using a stationary blade) at a temperature of from 70 to 90° C. into approximately thirty separate 2.0 mm (80 mil) thick sheets. Skiving was initiated from the top of each cake. Any incomplete sheets were discarded.

The ungrooved, polishing layer materials from each example were analyzed to determine their physical properties. Note that the pad density data reported were determined according to ASTM D1622-08 (2008); the Shore D hardness data reported were determined according to ASTM D2240-15 (2015); and, the modulus and elongation to break data reported were determined according to ASTM D412-6a (2006). Test results are shown in Tables 5, 6 and 7, below.

As determined by the proportion or amount of useful pad materials made from a single cast polyurethane cakes compared to the total amount of the cake, the resulting inventive polishing pads in Examples 2, 6 and 10 gave high casting yield for polishing pads. For example, relative to Comparative Example 7, the casting conditions for Examples 6 and 10 produce a higher casting yield while offering slightly improved polishing performance without the porosity of the pad in Comparative Example 7.

Test Methods:

The following methods were used to test the polishing pads: Chemical mechanical polishing pads were constructed using polishing layers. These polishing layers were then machine grooved to provide a groove pattern in the polishing surface comprising a plurality of concentric circular grooves having dimensions of 70 mil (1.78 mm) pitch, 20 mil (0.51 mm width) and 30 mil (0.76 mm) depth. The polishing layers were then laminated to a foam sub-pad layer (SUBA IV available from Rohm and Haas Electronic Materials CMP Inc.). The resulting pads were mounted to the polishing platen of the indicated polisher using a double sided pressure sensitive adhesive film.

A Mirra™ CMP polishing platform (Applied Materials, Santa Clara, Calif.) was used to polish 200 mm diameter TEOS (oxide) blanket wafers (Novellus Systems, Tualatin, Oreg.) with the indicated pads. The indicated polishing medium used in the polishing experiments was a CES333F (Asahi Glass Company) ceria slurry, KLEBOSOL II K1730 (Rohm and Haas Electronic Materials CMP Inc.) colloidal silica slurry, or ILD 3225 (Nitta Naas Inc.) fumed silica slurry. The polishing conditions used in all of the polishing experiments included a platen speed of 93 rpm; a carrier speed of 87 rpm; with a polishing medium flow rate of 200 mL/min and a down force of 31.0 kPa (KLEBOSOL and ILD slurries) or 20.7 kPa (CES333F slurry). An AM02BSL8031C1-PM (AK45) diamond conditioning disk (Saesol Diamond Ind. Co., Ltd.) was used to condition the chemical mechanical polishing pads. The chemical mechanical polishing pads were each broken in with the conditioner using a down force of 3.2 kg (7 lbs) for 40 minutes. The polishing pads were further conditioned in situ using a down force of 3.2 kg (7 lbs). The removal rates were determined by measuring the film thickness before and after polishing using a FX200 metrology tool (KLA-Tencor, Milpitas, Calif.) using a 49 point spiral scan with a 3 mm edge exclusion.

Planarization Efficiency (PE):

To assess the ability of an indicated pad to remove material in the step height reduction from a non-level and non-uniform substrate, a substrate pattern wafer with a step height of 8000 Å (CMP Characterization Mask Set, MIT-SKW7) was formed by chemical vapor deposition of TEOS in a lined pattern that includes rectangular sections of varying pitches (from 10 to 500 μm at 50% pattern density) and pattern densities (from 0% to 100% at a 100 μm line pitch). Planarization efficiency ratio was evaluated by optical interference using a RE-3200 Ellipsometric Film Thickness Measurement System (Screen Holdings Co). Planarization efficiency is defined as $1\text{-}RR_{low}/RR_{high}$. The planarization efficiency ratio was calculated by integrating under the curve of planarization efficiency vs. step height and dividing the result by the initial step height. Results are shown in Tables 5, 6 and 7, below.

PE (Norm):

In Table 7, this refers to planarization efficiency relative to Example 0 as a standard.

Defectivity:

The creation of defects during polishing was measured using a Hitachi High-Tech™ LS6600 metrology tool (Hitachi High Technologies Corporation, Tokyo, Japan) wherein the substrate was cleaned with HF (2 wt. % in water) to an etching amount of 400 Å TEOS. Target remaining TEOS thickness was 6000 Å. Defect count was determined in a wafer substrate which is not a pattern wafer by an LS6600 wafer surface inspection system with 0.2 μm resolution. Results are shown in Table 4, below.

Subtractive defects are scratches and chatter marks (not additive defects) counted using the metrology tool and confirmed by manual inspection by SEM (KLA-Tencor eDR5210 Review SEM) and are normalized to a pad of Comparative Example 1) which is assigned a value of 1.0. A lower number means less defects in the substrate after polishing.

Matrix Dry Hardness:

The matrix hardness was determined by taking a lab-cast plaque of the indicated polyurethane reaction product. Six samples were stacked and shuffled for each hardness measurement; and each pad tested was conditioned by placing it in 50 percent relative humidity for five days at 23° C. before testing and using methodology outlined in ASTM D2240-15 (2015) to improve the repeatability of the hardness tests.

Matrix Wet Hardness:

The matrix wet hardness was determine by cutting to samples from a lab-cast plaque and subjecting it to the same ASTM hardness analysis as in Matrix Dry Hardness after soaking in DI water for a period of 7 days.

TABLE 5

Planarization Efficiency and Defectivity with ILD3225 Fumed Silica Slurry[1]

| Example | Matrix Dry Hardness | Matrix Wet Hardness | Tan Delta (50C) | PE | Subtractive Defects (norm.) |
|---|---|---|---|---|---|
| 0* | 66.3 | 65.6 | 0.111 | 0.877 | — |
| 1* | 72.3 | 67.4 | 0.160 | 0.915 | 1.0 |
| 2 | 73.2 | 64.7 | 0.176 | 0.908 | 0.2 |
| 3* | 65.8 | 62.7 | 0.099 | 0.885 | — |
| 4* | 64.5 | 61.6 | 0.125 | 0.817 | 0.1 |
| 5* | 53.8 | 41.7 | 0.081 | 0.761 | — |
| 6 | 71.5 | 60.0 | 0.145 | 0.911 | 0.4 |
| 7* | 68.4 | 63.5 | — | 0.883 | — |
| 8* | 71.3 | 64.0 | 0.112 | 0.854 | — |
| 9* | 71.3 | 64.0 | 0.112 | 0.894 | — |
| 10 | 66.6 | 57.6 | 0.133 | 0.895 | 0.2 |

[1]ILD3225 fumed silica slurry;
*denotes comparative Example.

TABLE 6

Planarization Efficiency and Defectivity with K1730 Colloidal Silica Slurry[1]

| Example | PE | Subtractive Defects (norm.) |
|---|---|---|
| 0* | 0.773 | — |
| 1* | 0.874 | 1.0 |
| 2 | 0.877 | 0.2 |
| 3* | 0.840 | — |
| 4* | 0.765 | 0.2 |
| 5* | 0.592 | — |
| 6 | 0.896 | 0.4 |
| 7* | — | — |
| 8* | — | — |
| 9* | 0.837 | — |
| 10 | 0.888 | 0.2 |

[1]K1730 colloidal silica slurry;
*denotes comparative Example.

TABLE 7

Planarization Efficiency and Defectivity with CES333 ceria slurry

| Example | PE (norm.) | Subtractive Defects (norm.) |
|---|---|---|
| 0* | Medium | Medium |
| 1* | High | Very High |
| 2 | High | — |
| 3* | — | — |
| 4* | Medium | Low |
| 5* | — | — |
| 6 | Very High | Low |
| 7* | — | — |
| 8* | — | — |
| 9* | — | — |
| 10 | — | — |

1. CES333 ceria slurry, mean particle size 170 nm;
*denotes comparative Example.

As shown in Tables 5, 6 and 7, above, the pads of inventive Examples 2 and 6 maintain similar PE as a high quality prior art planarizing pad (Comparative Example 1) while exhibiting significantly attenuated defectivity with ILD3225 (fumed silica), K1730 (colloidal silica), and CES333 (conventional ceria) slurries compared to the same pad. The inventive Examples 2, 6 and 10 all gave improved PE as compared to IC1000 commercial pads (Comparative Example 0).

As shown in Tables 5, 6 and 7, above, the pads in inventive Examples 2, 6, and 10 offer similar, if not higher, planarization efficiency than a high quality prior art planarizing pad (Comparative Example 1) while exhibiting significantly decreased defectivity. This combination makes these formulations ideal for front-end-of-line polishing applications.

As shown in Table 5 and in Tables 6 and 7, by correlation of the same pad materials used in all three tables, the performance of the inventive Examples 2, 6 and 10 relates to the drop from dry hardness of the materials to the wet hardness of the materials while in use, their high flexural rigidity (EI), and their high damping component in the relevant polishing method as shown by tan delta similar to the good planarizing pad of Comparative Example 1. The inventive pads exhibit a unique decrease in hardness between their dry and wet states. Further, the Shore D hardness of the pads in Examples 2, 6, and 10 drops significantly (>10%) when they are wet. By comparison, the pad of Comparative Example 1 maintains high dry and wet hardness leading to high subtractive defects in substrates.

We claim:

1. A chemical mechanical (CMP) polishing pad for polishing a substrate chosen from at least one of a magnetic substrate, an optical substrate and a semiconductor substrate comprise a polishing layer adapted for polishing the substrate which is a polyurethane reaction product of a reaction mixture comprising a curative and a polyisocyanate prepolymer having an unreacted isocyanate (NCO) concentration of from 8.3 to 9.8 wt. % of the polyisocyanate prepolymer, the polyisocyanate prepolymer formed from a polyol blend of polypropylene glycol (PPG) and polytetramethylene ether glycol (PTMEG) and containing a hydrophilic portion of polyethylene glycol or ethylene oxide repeat units, a toluene diisocyanate, and one or more isocyanate extenders, and wherein the polyurethane reaction product in the polishing pad has a Shore D hardness according to ASTM D2240-15 (2015) of from 65 to 80 and exhibits a wet Shore D hardness according to ASTM D2240-15 (2015) after soaking in deionized (DI) water for a period of 7 days of from 10 to 20% less than the Shore D hardness of the dry polyurethane reaction product.

2. The CMP polishing pad as claimed in claim 1, wherein the polyisocyanate prepolymer has an unreacted isocyanate (NCO) concentration of from 8.6 to 9.3 wt. %.

3. The CMP polishing pad as claimed in claim 1, wherein the amount of toluene diisocyanate (TDI) used to form the polyisocyanate prepolymer ranges from more than 35 wt. % to 45 wt. %, based on the total wt. % of the reactants used to make the polyisocyanate prepolymer, wherein, further, the amount of the one or more isocyanate extenders used to form the polyisocyanate prepolymer ranges from 3 to 11 wt. %, based on the total weight of the reactants used to make the polyisocyanate prepolymer, and wherein, still further, the amount of the polyol blend used to form the polyisocyanate prepolymer ranges from 44 to less than 62 wt. %, based on the total wt. % of the reactants used to make the polyisocyanate prepolymer.

4. The CMP polishing pad as claimed in claim 1, wherein the polyol blend used to form the polyisocyanate prepolymer contains a hydrophilic portion and is chosen from (i) a polyol blend of PTMEG and PPG in a ratio of PTMEG to PPG of from 1:1.5 to 1:2 and a hydrophilic portion in the amount of from 20 to 30 wt. %, based on the total weight of reactants used to make the polyisocyanate prepolymer or (ii) a polyol blend of PTMEG and PPG in a ratio of PTMEG to PPG of from 9:1 to 12:1 wt. ratio and a hydrophilic portion in the amount of from 1 to 10 wt. %, based on the total weight of reactants used to make the polyisocyanate prepolymer.

5. The CMP polishing pad as claimed in claim 1, wherein the polyurethane reaction product is formed from a reaction mixture containing from 70 to 81 wt. %, based on the total weight of the reaction mixture, of the polyisocyanate prepolymer, from 19 to 27.5 wt. %, based on the total weight of the reaction mixture, of the curative and from 0 to 2.5 wt. %, of one or more microelements, based on the total weight of the reaction mixture.

6. The CMP polishing pad as claimed in claim 1, wherein the curative in the reaction mixture is chosen from a diamine or a mixture of a diamine and a polyol curative and the molar ratio of polyamine $NH_2$ groups to polyol OH groups ranges from 40:1 to 1:0.

7. The CMP polishing pad as claimed in claim 6, wherein the stoichiometric ratio of the sum of the total moles of amine ($NH_2$) groups and the total moles of hydroxyl (OH) groups in the curative in the reaction mixture to the total moles of unreacted isocyanate (NCO) groups in the reaction mixture ranges from 0.91:1 to 1.15:1.

8. The CMP polishing pad as claimed in claim 1, wherein the polishing pad or polishing layer has a density of 0.93 to 1.1 g/cm$^3$.

9. The CMP polishing pad as claimed in claim 1, wherein the polishing pad further comprises microelements chosen from entrapped gas bubbles, hollow core polymeric materials, liquid filled hollow core polymeric materials, and boron nitride.

10. A method for making a chemical mechanical (CMP) polishing pad having a polishing layer adapted for polishing a substrate comprising:

providing one or more polyisocyanate prepolymer as claimed in claim 1 at a temperature of from 45 to 65° C.;

forming a reaction mixture containing from 70 to 81 wt. %, based on the total weight of the reaction mixture, of the polyisocyanate prepolymer, from 0.0 to 2.5 wt. %, based on the total weight of the reaction mixture, of one or more microelements, wherein the microelements and the polyisocyanate prepolymer are blended together, cooling the polyisocyanate prepolymer and microelement mixture to from 20 to 40° C.;

providing, as a separate component, from 19 to 27.5 wt. %, based on the total weight of the reaction mixture, of a curative;

combining the components of the reaction mixture, preheating a mold to from 60 to 100° C.;

filling the mold with the reaction mixture and heat curing the reaction mixture at a temperature of from 80 to 120° C. for a period of from 4 to 24 hours to form a cast polyurethane; and, forming a polishing layer from the cast polyurethane.

* * * * *